United States Patent [19]

Johnson

[11] Patent Number: 4,956,963

[45] Date of Patent: Sep. 18, 1990

[54] METHOD OF SEALING A SHRINK WRAP PACKAGE

[75] Inventor: Stephen N. Johnson, Mechanicsville, Va.

[73] Assignee: Nordson Corporation, Westlake, Ohio

[21] Appl. No.: 271,024

[22] Filed: Nov. 14, 1988

[51] Int. Cl.[5] ..... B65B 9/06; B65B 53/02

[52] U.S. Cl. ..... 53/442; 53/450; 156/86; 156/203

[58] Field of Search ..... 53/383, 442, 450, 550, 53/557, 451; 118/300; 156/295, 578, 86, 203, 466; 427/208.2, 284, 285, 422

[56] References Cited

U.S. PATENT DOCUMENTS

| | | | |
|---|---|---|---|
| 2,546,721 | 3/1951 | Campbell | 53/450 X |
| 3,347,013 | 10/1967 | Piazze | 53/442 |
| 3,653,177 | 4/1972 | Adams et al. | 53/550 |
| 4,098,052 | 7/1978 | Singer | 53/450 X |
| 4,098,632 | 7/1978 | Sprague, Jr. | 156/295 |
| 4,183,193 | 1/1980 | Klingelhöfer | 53/450 |
| 4,478,670 | 10/1984 | Heyse et al. | 53/550 X |

*Primary Examiner*—Robert L. Spruill
*Assistant Examiner*—Linda B. Johnson
*Attorney, Agent, or Firm*—Wood, Herron & Evans

[57] ABSTRACT

An article is wrapped in a shrink film having a longitudinal seal. The longitudinal seal is formed by swirling hot melt fibers onto a longitudinal edge of the film and bringing longitudinal edges together to form an initial pressure-sensitive seal. The shrink film and hot melt are then subjected to the elevated temperature of shrink oven to shrink the film and to form a more complete bond at the longitudinal seam.

6 Claims, 1 Drawing Sheet

METHOD OF SEALING A SHRINK WRAP PACKAGE

This invention relates to the method of making the shrink wrap package and an improved method of forming the longitudinal seal on said package.

In the current method of wrapping a shrink film around a package and sealing it to form a shrink wrap package, a longitudinal web of indeterminate length is wrapped in tubular form about an article. A longitudinal seal on the longitudinal edges of the shrink film is formed by a static charge method which involves no adhesive. Transverse seals are formed between packages with conventional heat sealers. At each transverse seal, the film is cut through the center of the seal so as to form separate wrapped, unshrunk packages. The separate packages then pass through a heated shrink tunnel where the film is shrunk around the article.

The static charge method of forming the longitudinal seal is unreliable and, hence, the integrity of the package cannot be assured.

BRIEF SUMMARY OF THE INVENTION

An objective of the present invention has been to provide an improved longitudinal seal for a tubular shrink wrap package.

The objective of the present invention is attained by applying to a longitudinal edge of the shrink film a pressure-sensitive adhesive which, when it comes into contact with the opposed longitudinal edge of the film, provides an initial adhering force between the edges. As the packages are then conveyed through a shrink oven, the temperature of the film is raised well past the melting point of the adhesive, as the film is shrinking. The adhesive flows and more completely wets the opposed edges of the film and, after exiting from the heat tunnel, freezes to form a secure longitudinal seam.

In the preferred form of the invention, the pressure-sensitive adhesive is applied as a fibrous swirl produced by the apparatus of application Ser. No. 07/041,712, now U.S. Pat. No. 4,785,996 the disclosure of which is fully incorporated herein by reference to form a part of the present disclosure.

The contribution of the swirl of fibers is this: if a solid bead at the melting temperature of the hot melt were to be applied to the film, the film, at the seam, would have a tendency to shrink and thus distort prematurely while the rest of the film remained in unshrunk condition. This could result in an unsightly package after the package passes through the shrink tunnel. Furthermore, the premature shrinking of the film on the one longitudinal edge of the film would prevent a proper mating of that edge with the unshrunk opposed edge.

The application of the fibrous swirl avoids that problem, for the swirl is applied as a very thin film over a large area so that there is no such concentration of heat as would cause a premature shrinking of a longitudinal edge of the film before it could be joined to the opposed edge.

One advantage of the invention is that a better seal is formed, one which will not break open during handling of the product.

A second advantage, flowing from the first, is that a secure seal at the seam permits the shrinking of the film more snugly about the article.

BRIEF DESCRIPTION OF THE DRAWINGS

The several features of the invention will become more readily apparent from the following detailed description taken in conjunction with the accompanying drawings in which.

DETAILED DESCRIPTION OF THE INVENTION

Figure 1:
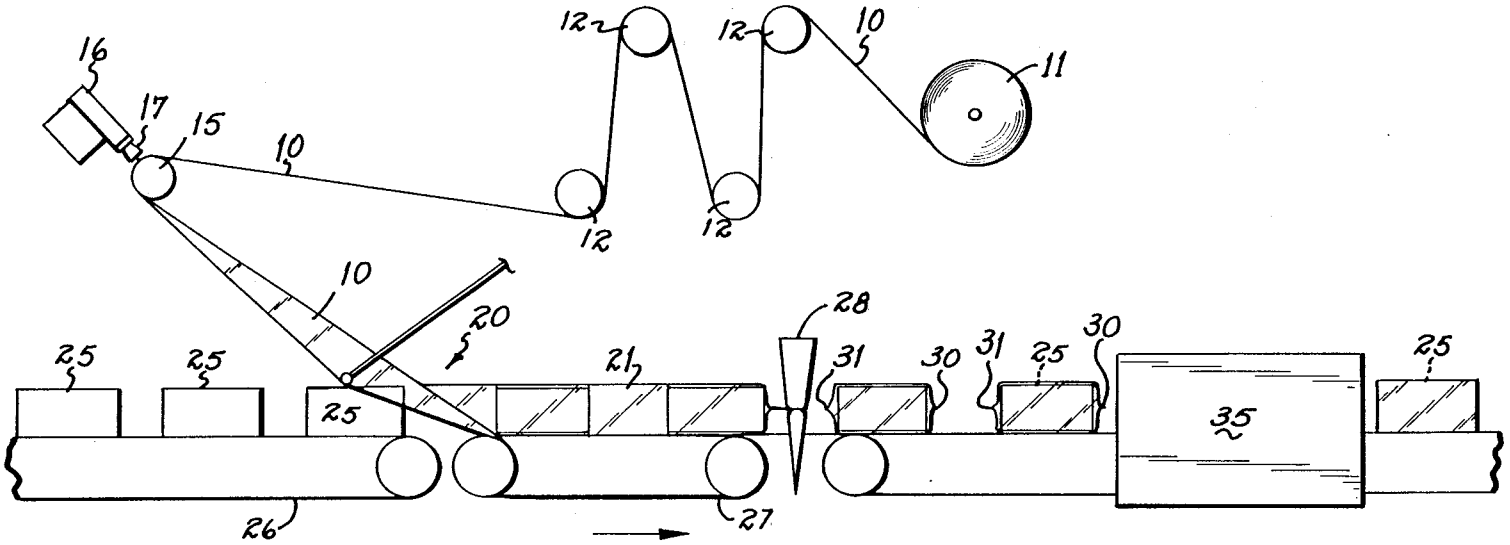
FIG. 1 is a diagrammatic side-elevational view of the apparatus on which the method of the present invention is formed.
Figure 2:
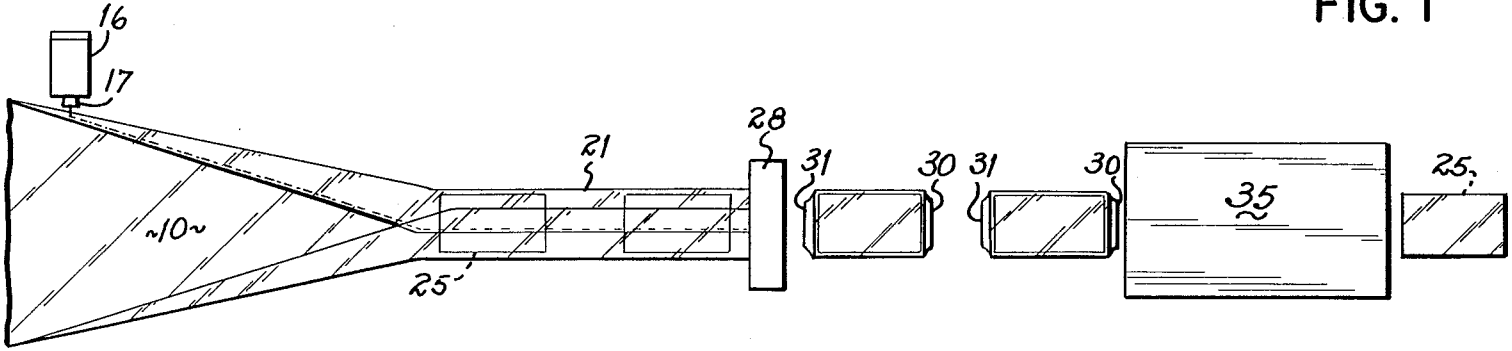
FIG. 2 is a diagrammatic bottom view of the method of the present invention.

As shown in the drawings, a web 10 of shrinkable polyvinylchloride is fed from a supply roll 11. The film is fed over a set of dancer rolls 12 which permit the film to accommodate the intermittent motion of the transverse cut-off. The film passes over an idler roll 15 adjacent a hot melt gun 16 having a swirl-creating attachment at the nozzle. In the hot melt gun 16, the hot melt adhesive is raised to melting temperature (325° F.) at which its viscosity is about 2300 cps. The hot melt exiting from the nozzle 17 is subjected to angled, tangential jets of air to stretch the bead into swirled tacky fibers. Thus, the mass of the bead of hot melt is dispersed so that when it strikes the longitudinal edge portion of the film, it will not heat the edge of the film to the point that it shrinks. The pattern of hot melt is, for example, about $\frac{3}{8}$ inch wide and $\frac{3}{8}$ inch inboard of the edge of the web. The film 10 then passes over a folding mechanism indicated at 20 to form a tube 21 having a longitudinal seal on its underside.

Articles 25 are conveyed on a conveyor 26 into the tube 21 as it is being formed by the folding mechanism 20. One article with which the present invention is particularly useful is a blanket. Another could be a pair of cylindrical cans of liquid product. The tube, with the article contained within it, is carried on a vacuum belt conveyor 27. The application of vacuum to the underside of the tube causes the longitudinal edges to press together sufficiently to form a preliminary seal. Alternatively, the weight of the product could bring the edges together. Since the adhesive is quite tacky, only a very light pressure is required to form the preliminary seam.

As the tube exits the vacuum belt conveyor, a transverse heat sealing and cutting bar 28 forms an end seal and a cut in the center of the seal to separate the packages. Thus, the trailing end of the downstream package and the leading edge of the upstream package are sealed so that each package has a leading seal 30 and a trailing seal 31. The packages then pass through the heat shrink tunnel 35. There, the packages are raised to a temperature of about 300° F. to 325° F. and held at that temperature for about two seconds until the film shrinks and pulls itself snugly about the article 25. As the temperature of the film is being raised, so is the hot melt being reheated to its melting temperature. When the hot melt achieves a molten stage, it will flow and thoroughly wet the surface of the opposed films, thereby forming a secure bond with those films.

Again, the light deposit of the hot melt fibers is ideally suited to this end of the process for, at this end of the process, the temperature of the hot melt will rise with the temperature of the film and will not lag behind it because of an undue mass as would be the case if the hot melt had been deposited as a bead.

In summary of the operation of the invention, hot melt is swirled as a mass of fibers onto a longitudinal edge of a web. The web is formed as a tube around an article 25 and the longitudinal edges of the tube are brought together where they adhere to one another through the tackiness of the pressure-sensitive hot melt. The tube is tranversely sealed and severed to form individual packages. The packages pass through a shrink tunnel where the temperature is raised to simultaneously shrink the film and raise the temperature of the hot melt to its melting temperature to form a secure bond. In the preferred form of the invention, the hot melt used is a rubber-based pressure-sensitive hot melt sold under the designation DISPOMELT TM No. 34-5519 by National Starch and Chemical Corporation, 10 Finderne Drive, Bridgewater, NJ. It has a viscosity of 2300 cps at 325° F. and is substantially clear upon application. The hot melt applicator has the following settings:

| | |
|---|---|
| Tank | 325° F. |
| Hot Melt Hose | 330° F. |
| Hot Air Hose | 350° F. |
| Gun | 330° F. |

Tank 325° F. Hot Melt Hose 330° F. Hot Air Hose 350° F. Gun 330° F.

The heating tunnel is maintained at 300° F. to 325° F. and the wrapped product spends about two seconds in the heat tunnel.

The adhesive forms a significantly improved bond after the excursion through the heat tunnel compared to the bond immediately before being subjected to the heat of the tunnel. It is believed that the improved bond occurs because of a more complete wetting of the PVC by the adhesive due to the heat of the tunnel and, hence, a greater surface area at the seam is covered by the adhesive.

It is believed that adhesives other than pressure-sensitive adhesives can make a satisfactory bond as long as the adhesive is caused, in the heating tunnel, to flow and wet the surfaces forming the seam.

From the above disclosure of the general principles of the present invention and the preceding detailed description of a preferred embodiment, those skilled in the art will readily comprehend the various modifications to which the present invention is susceptible. Therefore, I desire to be limited only by the scope of the following claims and equivalents thereof:

I claim:

1. The method of wrapping a package comprising the steps of:

applying a light deposit of pressure-sensitive hot melt adhesive to at least one edge of a polyvinylchloride heat-shrinkable film;

wrapping an article with said film;

bringing together opposed edges of said film with said adhesive between said edges; and heating said film to shrink it about said article and to cause the adhesive to flow to form a more complete bond between said opposed edges.

2. The method as in claim 1 in which:

the step of applying said adhesive includes subjecting a bead of adhesive to air jets to stretch said bead up into fibers, said fibers being deposited onto said film.

3. The method of wrapping a package comprising the steps of:

expressing a hot pressure-sensitive adhesive, subjecting said hot adhesive to jets of air to stretch the adhesive into a swirled fiber, depositing said fiber on at least one edge of a heat-shrinkable film;

wrapping an article with said film;

bringing together opposed edges of said film with said adhesive between said edges; and heating said film to shrink it about an article and to cause the adhesive to flow to form a stronger adhesive bond between opposed edges.

4. The method as in claim 3 wherein said film and adhesive are heated by passing the package through a heating tunnel at a temperature in the range of 300° F. to 325° F.

5. The method as in claim 4 in which said package is in said heating tunnel for about 2 seconds.

6. The method of wrapping a package with a web of heat-shrinkable polyvinylchloride film, said web having opposed longitudinal edges, said method comprising the steps of:

depositing a light application of pressure-sensitive hot melt adhesive onto one edge of said web;

forming said web into a continuous tube with said longitudinal edges overlapping at the underside of said tube and sandwiching said adhesive between said edges to preliminarily join said edges;

inserting longitudinally-spaced article in said tube whose weight, together with the pressure-sensitive adhesive, assists in temporarily holding said edges together;

transversely sealing and severing said tube to create individual packages;

and heating said packages to shrink said film and cause said adhesive to flow to form a more complete bond between said longitudinal edges.

* * * * *